US005342149A

United States Patent [19]

McCabe et al.

[11] Patent Number: 5,342,149

[45] Date of Patent: Aug. 30, 1994

[54] LONG HOLE CHEMICAL GROUT INJECTOR SYSTEM

[75] Inventors: Howard W. McCabe; William E. McCabe, both of Idaho Falls, Id.

[73] Assignee: McCabe Brothers, Inc., Idaho Falls, Id.

[21] Appl. No.: 937,177

[22] Filed: Aug. 31, 1992

[51] Int. Cl.[5] ..... E02D 3/12

[52] U.S. Cl. ..... 405/269; 405/303; 239/416.4; 239/424.5; 285/320

[58] Field of Search ..... 405/233, 236, 248, 263, 405/266, 267, 269, 303; 239/413, 416.4, 424.5; 285/319, 320

[56] References Cited

U.S. PATENT DOCUMENTS

| | | | |
|---|---|---|---|
| 4,302,132 | 11/1981 | Ogawa et al. | 405/269 |
| 4,449,856 | 5/1984 | Tokoro et al. | 405/269 |
| 4,710,063 | 12/1987 | Faktus et al. | 405/269 |
| 4,859,119 | 8/1989 | Chida et al. | 405/269 |
| 5,006,017 | 4/1991 | Yoshida et al. | 405/263 |
| 5,100,182 | 3/1992 | Norkey et al. | 285/319 X |

FOREIGN PATENT DOCUMENTS

| | | | |
|---|---|---|---|
| 115416 | 9/1981 | Japan | 405/269 |
| 2063337 | 6/1981 | United Kingdom | 405/269 |

*Primary Examiner*—Randolph A. Reese
*Assistant Examiner*—John Ricci
*Attorney, Agent, or Firm*—Douglas M. Clarkson; Risto A. Rinne, Jr.

[57] ABSTRACT

A system is described to separately furnish to an injector apparatus that is placed within a pipe two or more grout components. The injector apparatus is secured in position in the pipe by components of the injector apparatus that are urged into a position of cooperation with a modified section of pipe as a consequence of the increased hydraulic pressure that occurs within the injector apparatus during the pumping of one of the grout components thereinto. The two or more grout components after separately being furnished to the injector apparatus are then combined together by elements of the system and are then thoroughly mixed (reacted) together by other elements of the system to form a grout that is discharged from the system following their mixing together and prior to setting of the grout in ideal proximity with respect to a crack or crevice requiring grout application. All components of the system are recovered for subsequent use elsewhere.

24 Claims, 3 Drawing Sheets

LONG HOLE CHEMICAL GROUT INJECTOR SYSTEM

BACKGROUND OF THE INVENTION

1. Field of the Invention

The present invention, in general, relates to a system for injecting grout into cracks that require sealing via access holes and, more particularly, to apparatus that receive chemically reactive grout components separately, combine the components within the access holes near the crack, and then, inject the resultant grout into the crack.

It is necessary to inject grout to seal cracks and crevices which occasionally develop in a variety of structures. For example concrete dams may settle and crack, sometimes leaking water through the cracks that develop. Similarly cracks occasionally form in other types of structures such as tunnels, pipes, conduits, and sewer lines, for example. These cracks may be either above or below grade level.

A variety of reasons contribute to crack formation including settling of the structure, earthquake, accident, and other causes. In some cases, as hereinbefore mentioned, the cracks will leak water or other types of fluids therein and will therefore require timely repair. A crack or crevice through which there is a leakage of fluid is referred to as having a "pervasive flow" occurring therein. In other cases a leakage does not occur, yet the crack must nevertheless be repaired to prevent further deterioration of the structure from occurring.

Occasionally the cracks afford easy access and grout application is a task that is easily accomplished. Often though the cracks are difficult to access and require drilling long holes and injecting grout through the drilled holes.

The term "long hole" is used in favor of the term "deep hole" because sometimes the holes that are drilled in order to provide access to the cracks and crevices are indeed long, but not necessarily "deep" nor are the bored holes always in a direction that extends below the drilling equipment. It is necessary to drill at a variety of angles with respect to the drilling surface including drilling horizontally, down at some predetermined angle, or even in an upwards direction in order to access the crack that has formed. These types of drilled holes are often long but are not necessarily deep.

The difficulty with injecting grout into long holes is due simply to the fast reacting, and therefore also, the generally fast setting nature that is required of the two part (binary) chemical grouts that are, at present, commonly used for such purposes.

The most common of the binary chemical grouts that are used fall into one of the two general classifications of grouts, either monomers or polymers. Examples of monomer based grouts include the acrylamides, acrylates, and acrylics. A common example of a polymer grout is polyurethane. The polyurethanes are often referred to as simply the "urethanes" and include many of the preferred types of grouts that are used. Other types of binary chemical grouts not listed herein are sometimes appropriate for certain types of repair.

There are many "systems" for each of these grout families, each system usually referring to some particular characteristic of the cured grout. Examples of some systems include "gel", "flexible foam", "hard foam", and "solid" systems.

Certain repair situations respond better when certain types of grout systems are used. For example a solid grout system may be suitable for use to effect repairs when no further motion by the structure is anticipated. If continued motion by the structure is anticipated to occur, then repair may best be accomplished by the use of a gel or perhaps a flexible foam grout system.

Regardless of the grout system selected, all of the binary grouts are broadly defined to be any two part material that can be made to flow, usually by means of a pump, before the grout has had time to set or to cure. The terms "set" and "cure" are used interchangeably.

Each binary chemical grout formulation has one principle component part that is referred to as the "resin" and a second principle component part that is referred to as the "catalyst". The catalyst that is used for many of the preferred grouts is water (H2O). For certain binary grouts other chemicals may be combined with either the resin or the catalyst just prior to use. These chemicals are referred to as "additives" and they are used to modify some characteristic of the grout being used. For example certain additives are used to either lengthen or shorten the "setting" time of a grout.

For all types of binary chemical grouts when the catalyst component is blended with the resin component, a chemical reaction immediately begins to occur whereby a grout is formed. The process of blending the catalyst with the resin is often referred to as "reacting" the components. For many of the chemical grouts listed, a durable and expansive fast setting grout is thereby formed that is well suited for sealing these types of cracks and crevices.

Furthermore, it is not a practical option to attempt to slow reactant times while still preserving the fast setting time that is required. A slow reactant time (which would provide a longer time to set) is especially ill suited when injecting grout into formations having a pervasive flow occurring therein. The flow would tend to carry a slow reactant grout away before it had sufficient time to set and to adhere to its surroundings, thereby preventing an effective sealing of the crack from occurring. This type of situation is often encountered when sealing cracks that occur in water dam structures, for example.

It is also the case where "freezing sand" is a requirement. Freezing sand is an expression which originates from an industry practice whereby coolant is used literally to freeze sediments in position thereby permitting the accomplishment of some other task which requires a rigid formation. It is also currently used in industry to refer, generally, to the immobilization of sediments. In particular as used hereinbelow, freezing sand refers to the immobilization of sand, silt, and other sediments in position by means other than by merely a lowering of the temperature thereof.

Occasionally water dams and other structures develop a flow, usually by water, that is occurring underneath a portion of the reinforced dam structure or foundation. The reinforced portion of the dam structure may be constructed of concrete or of other materials. In this instance, water finds a path whereby it begins to flow underneath the reinforced portion of the structure. As the water flows it is constantly eroding more of the sand, silt, and other materials away from underneath the structure which in turn is enlarging the pathway under the structure, increasing the water flow rate, weakening the supporting base, and for as long as it continues, ever worsening and compounding the problem.

The necessary repair procedure in such a situation is to "freeze the sands" underneath the structure and it is in general quite similar to the required procedure for long hole crack repair having a pervasive flow occurring therein. A two part fast setting grout is reacted and is then injected onto the sand, silt, and other materials that are located underneath the reinforced portion of the structure where the leak is occurring thereby intersecting the flow of water. The fast setting grout mingles with the sand and silt and other materials and solidifies these materials into a unitized mass together with the grout.

A fortified and reinforced means of sealing the leak and also of preventing further erosion from occurring is thereby achieved. The result of this process is to "freeze the sands" that are located underneath the structure. A slow setting grout would in this instance also be removed and carried away by the pervasive flow before it had sufficient time to adhere to the sands and silt, thereby once again preventing an effective repair from occurring.

The hereinbefore described repair situations require that the preferred two part grout formulations, of necessity, have a short setting time. However if a grout formulation having a short setting time is reacted (mixed) at or near the drilling surface and is then piped through long holes to reach either a crack in the structure or a leak that is located underneath the structure, it will actually begin setting prior to reaching the repair area.

Consequently after the grout begins to set, its viscosity increases greatly so that it will no longer flow easily through the conduit that is used to transport the grout nor will it flow properly into the cracks and crevices that require sealing. Furthermore, once it begins to set it will no longer be capable of achieving an optimum bond with the materials surrounding the crack or the crevice. After a reacted grout begins to set, its efficacy at sealing cracks and crevices or of "freezing sand" is greatly diminished.

While a two part urethane grout is described as one of the presently preferred grout formations, other present and future grout formulations will also have to be fast setting for the same reasons as described hereinbefore. It does not matter if the grout formulation requires the mixing together of two or more component parts, to be effective at freezing sand and at sealing cracks in the presence of a pervasive flow, the grout, after having been reacted, must be fast setting. Any fast setting grout will in turn be difficult to pump through long holes and will also experience diminished repair efficacy if it is reacted too early prior to injection into the crack or onto the sands and silt to be frozen.

Accordingly there exists today a need for a long hole chemical grout injector system that is able to react the grout components in ideal proximity with respect to the crack that is being sealed or with respect to the sands and silts to be frozen. Clearly, an apparatus which allows for the reacting of grout constituents at a close and predetermined location with respect to the crack or crevice requiring repair is a useful and desirable device.

2. Description of Prior Art

Chemical grout injectors that are placed within long holes at a predetermined location away from a crack or crevice where they are used for the mixing (reacting) of grout constituents prior to injection of the grout into the crack or crevice are not hereinbefore known. Means for reacting grout at the surface of a long hole and thereafter pumping the mixture into a crack or crevice are known.

Means of pumping grout components separately into a long hole through an inner and an outer pair of grout pipes arranged in a coaxial manner and into a mixing chamber that is located at the end thereof are known. The use of coaxial grout pipes and a mixing chamber does not, however, ensure the complete reacting together of grout components, especially in the presence of a pervasive flow. Coaxial grout pipes also tend to be difficult to extract from a long hole following usage.

While the structural arrangements of other grout injection devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a chemical grout injector system that is particularly well suited to the injection of all types of fast reacting binary grouts into deep holes when there is a need to control the time interval after having reacted the grout constituents together until the time when the reacted grout is injected into the area requiring sealing.

Another object of the invention to provide a chemical grout injector apparatus that is capable of maintaining grout components separate from each other until the components reach an optimal distance away from the crack or crevice requiring repair and to react the components together at that ideal location.

Still another object of the invention to provide a chemical grout injector apparatus capable of automatically and adequately reacting grout components together at a predetermined location with respect to a crack or crevice.

Yet another object of the invention is to provide a chemical grout injector apparatus which discharges the reacted grout therefrom and into the crack or crevice to be sealed or onto the sand or silt to be frozen.

Briefly, a long hole chemical grout injector system for use in the mixing of binary grout components together and thereafter injecting the resultant reacted grout into a crack or crevice that is constructed in accordance with the principles of the present invention has an injector apparatus that is of a shape and size suitable for insertion into a bored hole, and has a means for securing the long hole chemical grout injector apparatus in position within the bored hole during grout injection, a means for separately receiving grout components that are pumped therein, a means for maintaining the separation of components passing through a portion of the grout injector apparatus, a means for combining and thoroughly mixing (reacting) the grout components together, a means for discharging the reacted grout therefrom, and a means for releasing and thereby retrieving the long hole chemical grout injector apparatus from the bored hole.

DETAILED DESCRIPTION OF THE INVENTION

Figure 1:
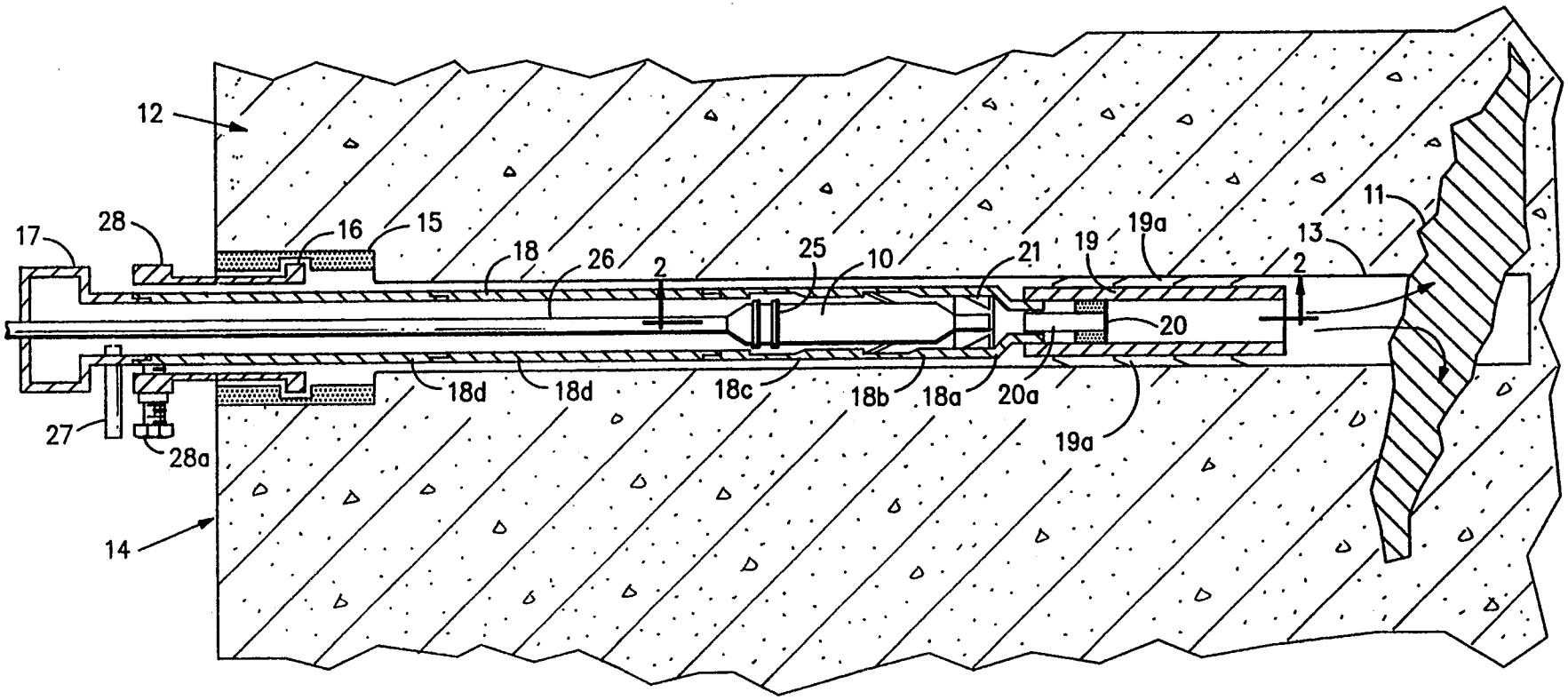
FIG. 1 is a cross sectional view of a portion of a structure in need of crack repair having a preferred form of chemical grout injector apparatus inserted into proper position within a bored hole prior to the injection of grout.

Referring to FIG. 1 is shown a long hole chemical grout injector apparatus identified, in general, by the numeral 10. Details relating to the construction of the injector 10 are included hereinafter. The injector 10 is shown in relation to a crack 11 that is in need of sealing which has formed in a structure 12.

For the purpose of this discussion the structure 12 is assumed to be a concrete water dam and water (not shown) is assumed to be flowing through the crack 11.

A long hole 13 of suitable diameter and length has been bored into the wall 14 of the dam structure 12 so as to intersect and pass through the crack 11. The long hole 13 is bored through the dam structure 12 at the required angle so as to reach the crack 11 and may typically require drilling through rock, cement, and other materials by the use of a core-type diamond drill boring apparatus (not shown).

The access area that is provided in most dam structures 12 is referred to as the gallery area (not shown). The gallery is a narrow corridor, much like a tunnel, which runs along the length of the water dam structure 12. Therefore the wall 14 (shown) is one of the two gallery walls (other wall not shown). The long hole 13 is bored starting from the one gallery wall 14 providing that the gallery affords the best access to the crack 11. Otherwise the long hole 13 is bored starting from an exterior location of the structure 12 that affords the best access to the crack 11.

While only one such long hole 13 is shown, actual repair of the crack 11 often requires the drilling of many such long holes 13, each of which intersects, and thereby provides access to, a portion of the crack 11. The injector 10, as hereinafter described, is used in each of the long holes 13 that is bored to supply an adequate amount of grout to completely fill the expanse of the crack 11.

The long hole 13 is considered to be "long" if the grout formulation that is used to seal the crack 11 would begin to set enough to increase its viscosity during pumping prior to reaching the crack 11 if the grout components were to be reacted (mixed together) at or near either the gallery wall 14 or "collar" area (not shown). The area where either drilling of the long hole 13 or pumping of the grout originates, whether in the gallery or on the surface of the structure 12, is referred to as the "collar" area.

Whenever a fast setting grout is used even a very short hole 13 is considered "long" if it can benefit from the use of the injector 10. Hereinafter whenever reference is made to a "hole 13" it is assumed to be long enough so as to derive benefit from the use of the chemical grout injector 10 apparatus for the sealing of cracks 11. Reference to a "hole 13" and to a "long hole 13" are used interchangeably throughout the specification.

Core samples (not shown) are periodically extracted during the drilling process, and it is by a monitoring of the removed core samples that a verification of the intersection of the hole 13 with respect to the crack 11 is confirmed. This is accomplished both by noting a discoloration of the core sample in the vicinity of the crack 11 as well as by a study of the actual core sample materials that are extracted and sometimes by noting the presence of contaminants (not shown) that have migrated into the crack 11 as a result of any pervasive flow which may be occurring therein. If a pervasive flow is not occurring, confirmation may involve a more careful study noting fractures and possible voids in the extracted core samples.

To facilitate crack 11 repair it is necessary to add cement grout reinforcement 15 to an enlarged portion of the hole 13 that is formed immediately upon penetration into the gallery wall 14. The cement grout reinforcement 15 is used to provide an anchor location for affixing a pipe coupling 16 that is cemented directly to the structure 12.

The pipe coupling 16, in turn, is useful for securing and maintaining the drilling apparatus (not shown) in proper alignment during subsequent boring of the hole 13, and later for securing a packing gland 17 and a packer pipe 18 in the desired position. The packing gland 17 and packer pipe 18 are described in greater detail hereinafter.

Figure 2:
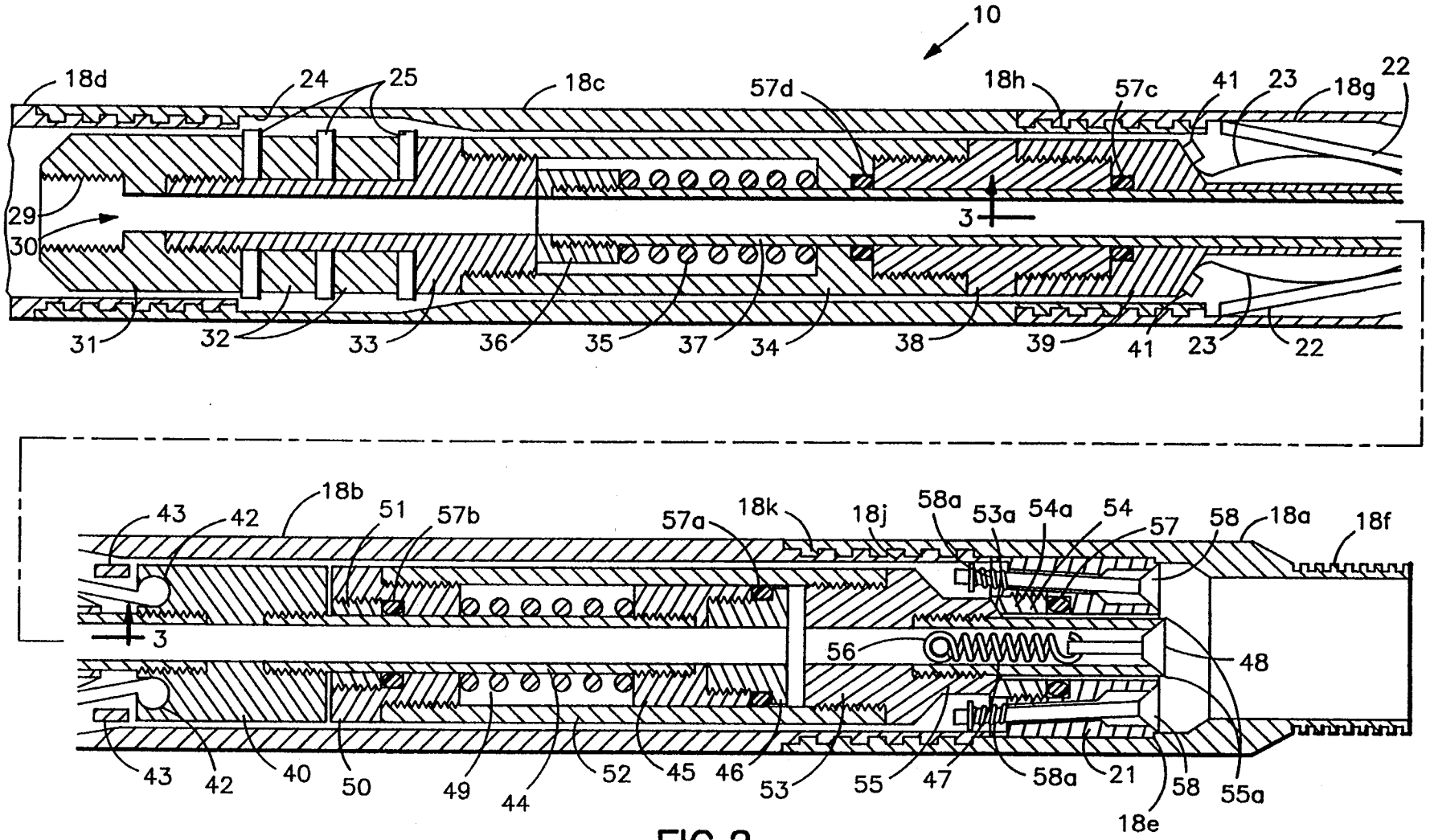
FIG. 2 is cross sectional view of the injector apparatus only when taken on the line 2—2 in FIG. 1.

Referring also to FIG. 2, the packer pipe 18 is comprised of three threaded specially modified sections **18*a*, 18*b*, 18*c* and a plurality of as many as is required threaded standard sections 18*d* that are assembled together in specific order and are then inserted, section by section, into the hole 13**.

Certain modified sections **18*a*, 18*b*, 18*c*, of the packer pipe 18 are fabricated so as to cooperate with the injector 10. Details of construction of the modified sections 18*a*, 18*b*, 18*c*** are included hereinafter.

After having bored the hole 13 and after having affixed the pipe coupling 16 thereto, the next step in the process of deep hole 13 crack 11 repair is to first properly prepare and to then insert the modified sections **18*a*, 18*b*, 18*c* and the remaining standard sections 18*d* of the packer pipe 18 into the hole 13. Preparation begins with the first section 18*a* of the packer pipe 18 and requires the assembly together of a cup packer 19 and of a resident rod 20**.

The resident rod 20 is attached by threads (not shown) to the inside of the cup packer 19. The cup packer 19 having the resident rod 20 attached therein is attached to the end threads **18*f* of the first section 18*a* of the packer pipe 18**.

Construction of the cup packer 19 includes a plurality of circular packer seals **19*a* about its periphery to prevent any water that may be flowing in the crack 11 from otherwise passing beyond the cup packer 19, around the outside of the packer pipe 18, and flowing in the space between the outside diameter of the packer pipe 18 and the inside diameter of the hole 13**.

The packer seals **19*a* are typically constructed of either rubber, neoprene, leather, or some other type of pliable material. The inside of the cup packer 19 is open to allow for the reacted grout, as is described hereinafter, to flow out from the end of the cup packer 19 and into the crack 11**.

The resident rod 20 is a known method of mixing substances together that relies upon inducing a motion by the substances that are forced to pass therein which, consequently, agitates and blends the substances together. The use of a resident rod 20 to react grout components together in a long hole 13 is not hereinbefore known.

Inside the resident rod 20 are angle clips 20*a* that are affixed firmly in position within the resident rod 20. The angle clips 20*a* cause the materials being forced therein to swirl around as they pass through the resident rod 20 and, therefore, to mix thoroughly together. The resident rod 20 thereby improves the efficacy by which the resin and the catalyst are reacted.

The first section 18*a* has a lip 18*e* area which serves to limit on the one side the allowable travel of a valve assembly 21. The valve assembly 21 is inserted as shown into the first section 18*a* before the second section 18*b* is threaded onto the first section 18*a*.

The second section 18*b* of packer pipe 18 is fastened onto the first section 18*a* by tightening the threads 18*j* of the second section 18*b* onto the corresponding first section threads 18*k* thereby securing the valve assembly 21 in position therein.

The threads 18*j* of the second section 18*b* bear upon the valve assembly 21 and force the valve assembly 21 in turn to bear tightly against the lip 18*e*. As such the valve assembly 21 forms a seal to prevent any fluid (water or resin) from flowing, in either direction, through the space between the lip 18*e* and the valve assembly 21.

The end threads 18*h* of the third section 18*c* are then used to secure the third section 18*c* to corresponding threads (not enumerated) of the second section 18*b*.

The sub-assembly of packer pipe 18 now consists of the first section 18*a* having with the cup packer 19 attached thereto and the resident rod 20 located therein at one end thereof, and at the remaining end thereof, having the valve assembly 21 located therein between the first section 18*a* and the second section 18*b* and also having the third section 18*c* attached to the second section 18*b*. The sub-assembly is inserted into the hole 13 beginning first with the cup packer 19.

The second section 18*b* contains a locking area 18*g* that consists of a thinner inside diameter portion that is formed near to where the second section 18*b* is threaded onto the third section 18*c*. The locking area 18*g* of the second section 18*b* provides an area whereby the locking dogs 22 of the injector 10 are able to expand under leaf spring 23 tension, as shall be hereinafter described in greater detail, and to rest upon the end threads 18*h* of the third section 18*c*.

The locking dogs 22 thereby serve to secure the injector 10 in place within the packer pipe 18 during grout application. The distance the locking area 18*g* is located from the lip 18*e* is controlled to ensure that when the injector 10 is fully inserted into the packer pipe 18, the locking dogs 22 will be in the proper position to expand into the locking area 18*g*.

The third section 18*c* of the packer pipe 18 contains a water by-pass 24 area consisting of a thinner inside diameter near to where the third section 18*c* is threaded onto a standard section 18*d* that is similar in construction to the locking area 18*g* of the second section 18*b*. The purpose of the water by-pass 24 is to allow water to flow past the pump-in glands 25 and around the body of the injector 10.

The distance that the water by-pass 24 is located from the lip 18*e* of the packer pipe 18 is set to ensure that the length of the injector 10 and the valve assembly 21, when combined, will result in the pump-in glands 25 of the injector 10 resting in the area afforded by the water by-pass 24 when the injector 10 is fully inserted into the packer pipe 18.

The injector 10, when it is later inserted into the fully assembled packer pipe 18 behind the valve assembly 21, is thus permitted to travel within the packer pipe 18 only until it contacts the valve assembly 21. Additional detail regarding the insertion of the injector 10 into the packer pipe 18 is included hereinafter.

A standard section 18*d* is threaded onto the third section 18*c* and is thereafter inserted into the hole 13. As many standard sections 18*d* are used as is required. The number of standard threaded sections 18*d* that are used is determined by the length of the hole 13 and by the desired placement of the injector 10 with respect to the crack 11. The overall length of each standard section 18*d* that is used may vary providing each standard section 18*d* is able to thread onto either the third section 18*c* or onto other standard sections 18*d*.

The length chosen for each of the three modified sections 18*a*, 18*b*, 18*c* is set to correspond properly with the length of the injector 10 and the valve assembly 21, and cannot be altered without making similar changes to the dimensions of either the injector 10 or valve assembly 21. Therefore in order to control precisely the overall length of the packer pipe 18, the length of each standard section 18*d* as well as the number of standard sections 18*d* that are used are varied accordingly.

Additional standard sections 18*d* are added, one by one, and inserted into the hole 13 until the overall length of packer pipe 18 that is desired has been obtained. The outside diameter of all modified sections 18*a*, 18*b*, 18*c*, and of the standard sections 18*d* of the packer pipe 18 must, of necessity, be somewhat less than the inside diameter of the bored hole 13.

The overall length that is chosen for the packer pipe 18 is selected to terminate with the cup packer 19 being situated a predetermined distance away from the actual crack 11. The bored hole 13, as shown, will normally proceed a short distance beyond the actual crack 11 and will then terminate at the point where drilling had stopped and the last core sample had been extracted.

The final position that is selected for the placement of the first section 18*a* of the packer pipe 18 within the hole 13, and therefore also for the injector 10, cup packer 19, and resident rod 20, is a repair specific variable that depends upon a variety of factors. In general, the distance that is selected for the injector 10 to be placed from the crack 11 during grout application is governed by the amount of time that the grout will have to set prior to reaching the crack 11.

Both the reactant and setting times of the grout formulation are determinant factors which are used to establish the placement of the injector 10, as are the pervasive flow rates which may be occurring through the crack 11. The size of the crack 11, and the materials surrounding the crack 11 to which the grout must adhere to, are also influential factors as is the speed at which the grout components are being pumped into the hole 13.

In certain instances the cup packer 19 is placed only inches away from the crack 11 while in other specific instances it is located many feet away from the crack 11. The design of injector 10 allows for the functional placement of the injector 10 anywhere within the length of the hole 13. The depth within the hole 13 to which the first section 18*a* is inserted limits the depth to which the injector 10 may later be inserted as well. Grout discharge, which occurs at the end of the cup packer 19, can be set to occur directly adjacent to the crack 11 or from a location that is considerably closer to the collar area.

In this manner the injector 10 is suitable for use over a very wide range of crack 11 repair situations and with a wide variety of two-part (binary) grouts having various reactant and setting times while also being able to take into account the many other application specific requirements that warrant consideration.

After the entire packer pipe 18 has been fully assembled, section by section, and has been pushed into the hole 13 so that the first section 18*a* has reached the desired location (depth) within the hole 13, then the packer pipe 18 is secured in position by the pipe coupling 16 and by other component parts of the injector 10 system that are attached to the pipe coupling 16 and are described hereinafter.

After the fully assembled packer pipe 18 has been inserted into the hole 13 to the depth desired for grout application, the packer pipe 18 is maintained in position by affixing the packer pipe 18 securely to a packer pipe clamp 28 that is attached to the pipe coupling 16.

The packer pipe clamp 28 is attached to the pipe coupling 16 and is used to secure the packing gland 17 and the packer pipe 18 to the pipe coupling 16 thereby maintaining the assembly in a static position with respect to the dam structure 12. Attached to the packer pipe clamp 28 are one or more threaded bolts 28*a* which engage corresponding threads (not shown) within the packer pipe clamp 28 and, when tightened, pass through clearance holes (not shown) that are provided for each bolt 28*a* in the packer pipe clamp 28 until each bolt 28*a* bears upon the packer pipe 18 that is located therein, thus securing it in position. The packer pipe clamp 28 is also sometimes referred to as a "spider clamp".

The injector 10 is inserted next into the assembled packer pipe 18 from the collar area. The injector 10 is connected to a urethane injection hose 26 that first passes through the center of the packing gland 17 and is then secured to a nipple (not shown) that is attached to nipple threads 29 located at one end of the injector 10.

At this point, the injector 10 is located inside the packer pipe 18 near the collar area. Details as to how the injector 10 is moved from the collar area to the end of the packer pipe 18 near the crack 11 are included hereinafter.

The packing gland 17 is attached next to the end of the packer pipe 18 by pipe threads (not shown) or by other attachment methods as are known and appropriate.

The urethane injection hose 26 is a type of conduit that is used generally to convey the resin component of the chemical binary grout formulation that is to be pumped (later) under pressure to the injector 10. The urethane injection hose 26 is typically constructed of a strong and flexible polyvinylchloride (PVC) material, although other pipe materials are used as well. The advantage to the use of PVC is that it is flexible, relatively inexpensive, continuous, and strong.

The packing gland 17 is used to permit the pumping of fluids into the packer pipe 18 while maintaining separation of the fluids, each from the other. For use with a polyurethane grout, urethane resin is normally pumped into the urethane injection hose 26 and water (the catalyst) is pumped into the water inlet port 27. The water (not shown) that is pumped into the inlet port 27 flows in a coaxial path around the urethane injection hose 26 and bears upon the pump-in glands 25 of the injector 10.

For use with other types of binary (two part) grouts, each of the other grout components would be pumped separately, one into the urethane injection hose 26 and the other component into the water inlet port 27 accordingly.

If a grout requiring the mixing of three or more component parts together is used, the present injector 10 system is equally viable without modification providing the components may be combined at the collar area in some non-reactive fashion so as to reduce the materials to be pumped to the injector 10 to two formulations whereby one formulation is pumped into the urethane injection hose 26 and the other formulation is pumped into the water inlet port 27. Either formulation may contain the resin or the catalyst as well as any additives that are used, providing the two formulations are maintained separate from each other until they reach, and are combined by, the valve assembly 21 of the injector 10.

If a three part (tertiary) grout formulation is used which does not permit combining any of the components together until just prior to a full and complete blending together (reacting) of all grout components, then the injector 10 system is modified accordingly as would be obvious to those now skilled in the art.

For example, one such modification would be to use an additional injection hose (not shown) passing through a modified packing gland (not shown) in addition to the urethane injection hose 26. Both injection hoses would connect together at a "Y" shaped adapter (not shown) attached to the nipple (not shown) of the injector 10 whereby two of the grout components would be combined together upon entry into the "Y" adapter of the injector 10, a moment before the third component part is combined (reacted) with the other two combined components by the valve assembly 21 of the injector 10.

Other similar types of modifications made to the injector 10 as are made necessary for use with certain specialized grout formulations are thereby anticipated. For example, if a grout formulation requiring four or more component parts to be maintained separately is used, additional urethane injection hoses (not shown) are are routed to pass through a specially modified packing gland (not shown) and are connected to additional "Y" shaped adapters (not shown) that are located near the injector 10. As such the beneficial use of the injector 10 with a wide variety of present and future types of chemical grouts and additives is assured.

The water (or other type of catalyst) that is pumped under pressure into the inlet port 27 of the packing gland 17 flows through the packing gland 17, around the urethane injection hose 26, and bears upon the pump-in glands 25 of the injector 10. The pump-in glands 25 form a tight seal against the inside diameter of the packer pipe 18. Therefore as water is pumped under pressure, the injector 10 is pushed by the force of the water further along into the packer pipe 18.

As the injector 10 is being pumped into position within the packer pipe 18, additional urethane injection hose 26 is also being furnished off of a reel (not shown) thereby allowing the injector 10, with the injection hose 26 attached thereto, to travel within the packer pipe 18 until the injector 10 reaches the valve assembly 21 that is located at the end of the packer pipe 18.

The injector 10, upon reaching the valve assembly 21 as it is being pumped into position, engages and enters into a portion of the valve assembly 21 (as is described in greater detail hereinafter) until the injector 10 eventually reaches the limit of allowable travel. When that occurs the injector 10 can not be pumped (conveyed) by additional water pressure any further into the packer pipe 18.

While the injector 10 is being pumped into position it is noted that only water (the catalyst) under pressure is being furnished. There is no resin flow at this time occurring through the urethane injection hose 26.

Furthermore if a pervasive flow is occurring through the crack 11, water will be flowing from the crack 11, through the packer pipe 18, and out of the collar area of the packer pipe 18, providing that the collar area is located in elevation below the surface level (head) of the water that is contained by the dam structure 12.

Once the injector 10 is inserted into the packer pipe 18 the pump-in glands 25 provide a seal that contains the flow of water originating from the crack 11 to one side thereof of the pump-in glands 25. As the injector 10 is pumped further along into the packer pipe 18, the water that is located within the packer pipe 18 is forced, by the movement of the injector 10 and seal provided by the pump-in glands 25, out of the center of the valve assembly 21, cup packer 19, and resident rod 20 back into the crack 11.

A walking beam pump (not shown) is a method well known to control all factors involving the pumping of numerous liquids, either independent of each other or simultaneously. By adjusting the position of a piston-type pump that is positioned along the walking beam, the stroke of the piston pump is thereby established. As many piston pumps are connected to the walking beam as are there components to be pumped.

A longer stroke when established for a piston pump attached to the walking beam will pump a greater proportion of one component (liquid) whereas a shorter stroke will pump a lesser proportion of the same or another component (liquid). By individually varying the proportion of each of the binary components (resin and catalyst) that are being pumped simultaneously to the injector 10, it is possibly to supply the two grout components to the injector in any desired ratio.

If for example twice as much catalyst as resin is required, then the catalyst (water) pump is connected to the walking beam so as to have a stroke twice as long as that of the resin pump. Optionally the piston pump chosen to pump the catalyst is selected to have a cylinder inside bore diameter that provides for a greater quantity of catalyst to be pumped with a shorter stroke.

Similarly if a piston of one of the pumps to be used is simply not connected to the walking beam then it is effectively disabled, and no fluid will flow through that particular pump. It is by this manner that a selection of the substances to be pumped is achieved. If, for example, only water is to be pumped in order to move the injector 10 to position at the end of the packer pipe 18, then only the water piston pump is connected at that time to the walking beam pump.

Later when both the catalyst and the resin are to be pumped simultaneously to the injector 10, an additional pump that is used to convey the resin to the injector 10 is connected to the walking beam pump and the walking beam pump is then turned on to supply, in the proportion that is desired, both substances simultaneously.

Any number of desired piston pumps are connected to the walking beam pump (or to a plurality of walking beam pumps if desired) to provide for the simultaneous pumping of all necessary grout components to the injector 10. Well known means to regulate the pressure of each grout component (catalyst and resin) are employed as an integral part of the walking beam pump.

When the injector 10 is in position at the end of the packer pipe 18, actual grout application may begin. The walking beam pump, as hereinbefore mentioned, is turned off, the pump that is used to supply the resin is attached to the walking beam pump, and the walking beam pump is turned on again. Additional details as to actual system operation during grout application are provided in the section of the specification entitled "Operation".

In general, during grout application the resin flows down inside the urethane injection hose 26, past the nipple threads 29, and into a center channel 30 of the injector 10. The nipple threads 29 are located on one side of a first coupling 31.

Adjacent to the first coupling 31 are the first of three pump-in glands 25, each separated by one of two spacers 32. The spacers 32 and pump-in glands 25 are located between the first coupling 31 and a second coupling 33 and they are secured in position by threading the second coupling 33 to the first coupling 31.

Attached by threads to the second coupling 33 is a third coupling 34. Located between the third coupling 34 and second coupling 33 is a first coil spring 35. The first coil spring 35 bears against one surface of the third coupling 34 and also against a first fitting 36.

The first fitting 36 is connected by threads to a first pipe nipple 37. The first pipe nipple 37 extends past the inside of the third coupling 34, past the inside of a fourth coupling 38, past the inside of a fifth coupling 39, and is attached by threads to a dog pivot coupling 40. The first pipe nipple 37 is able to slide longitudinally along the axis as provided within the centers of the third, fourth, and fifth pipe couplings 34, 38, 39 as required.

The fifth coupling 39 has two leaf springs 23 secured thereto by screws 41. The locking dogs 22 are free to pivot about the hinge 42 of the dog pivot coupling 40. The leaf springs 23 supply a force which tends to urge the locking dogs 22 so as to pivot in a direction that is, in general, away from the body of the injector 10. The outward pivoting motion of the locking dogs 22 is restrained by the dog retractor lips 43 of the fifth coupling 39.

Figure 4:
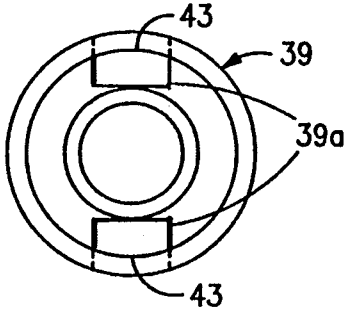
FIG. 4 is an end view of the fifth coupling component of the injector apparatus.
Figure 3:
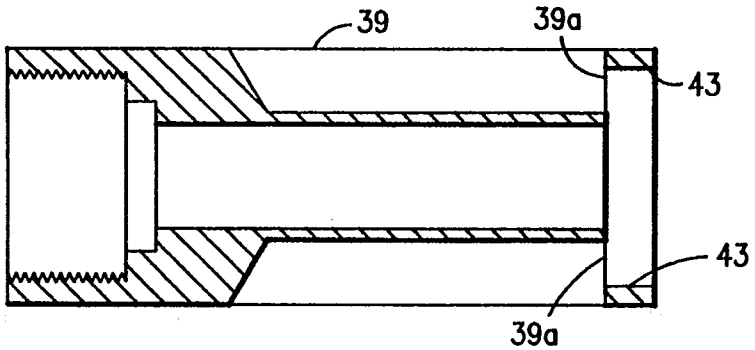
FIG. 3 is a cross sectional view of a fifth coupling component only of the injector apparatus taken along the line 3-3 in FIG. 2.

Greater detail of construction of the fifth coupling 39 is shown in FIG. 3 and in FIG. 4. Two dog slots **39*a* are provided in one end of the fifth coupling 39 through each of which pass one of the locking dogs 22. The outward pivoting motion, as mentioned hereinbefore of the locking dogs 22, is limited to the angle of produced between each of the locking dogs 22 as is bears against each of the dog retractor lips 43**.

Accordingly, as the dog pivot coupling 40 is moved to a relative position that is closer to the fifth coupling 39, then the locking dogs 22 will not contact the dog retractor lips 43 but will instead pivot to their maximum extent away from the body of the injector 10, as urged by the leaf springs 23, until the locking dogs 22 make contact with the locking area **18*g* of the second section 18 of packer pipe 18**.

Conversely, as the dog pivot coupling 40 is moved to a relative position that is further away from the fifth coupling 39, then the locking dogs 22 will make contact with the dog retractor lips 43 which will, in turn, cause the locking dogs 22 to pivot to a retracted position that aligns the dogs 22 closer with the body of the injector 10. The locking and unlocking of the dogs 22 is described in greater detail hereinafter under the section of the specification entitled "Operation".

A second pipe nipple 44 is attached by threads to the dog pivot coupling 40 and to a sixth coupling 45. The sixth coupling 45 is connected by threads to a resin piston 46.

Resin, when flowing through the injector 10, is able to pass unimpeded along the center channel 30 beginning from the nipple threads 29, past the center opening of the resin piston 46, and directly to a resin spring 47. From the resin spring 47 the resin passes to and bears upon the sealed surface of a resin valve 48.

The sixth coupling 45, on the side opposite to the side having the resin piston 46 attached thereto, bears upon a second coil spring 49, which in turn bears upon a second fitting 50. Connected to the inside threads of the second fitting 50 is a bushing 51. The inside of the bushing 51 and second fitting 50 are able to slide longitudinally along the axis over the second pipe nipple 44.

A third pipe nipple 52 is connected by threads to the outside of the second fitting 50 at one end and to a seventh coupling 53 at the other end. The seventh coupling 53 has a beveled edge **53*a* which bears upon a corresponding beveled edge 54*a* of a valve bushing 54. The valve bushing 54 is attached by threads to the valve assembly 21**.

Attached by threads to the inside of the seventh coupling 53 is a resin valve seat 55. The resin spring 47 is secured by a resin spring pin 56 to the resin valve seat 55 at one end and to the end of the valve stem of the resin valve 48 at the other end thereof. The resin spring 47 is normally under tension and as such maintains the resin valve 48 in the normally closed position (shown) unless the resin spring 47 tension is overcome by the force of the resin being pumped to the injector 10 that is pushing against the back surface of the resin valve 48.

An O-ring 57 seal in the valve assembly 21 provides a water tight hydraulic seal between the valve assembly 21 and the resin valve seat 55. The preferred O-ring 57 type of seal is sometimes referred to by the tradename of "PolyPak". Located throughout the injector 10 additional seals **57*a*, 57*b*, 57*c*, 57*d*** are used where needed to prevent the passage of one type of fluid (either resin or water) from occurring beyond a certain point.

Figure 5:
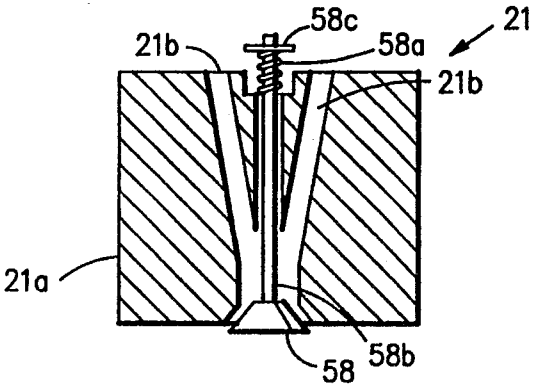
FIG. 5 is a cross sectional view of a portion of the valve assembly component of the injector apparatus.

Referring on occasion also to FIG. 5 is shown two of four water valves 58 that are located concentrically about the valve assembly block **21*a* of the valve assembly 21**.

A water valve spring **58*a* that is located about each of the water valve stems 58*b* is secured in position on one end by a clip 58*c* and on the other end by the valve assembly block 21*a*. Each water valve spring 58*a* supplies a force to maintain each of the four water valve 58 in the normally closed position. The valve assembly block 21*a* provides for two water ports 21*b* for each of the four water valves 58 which merge together above each of the four water valves 58**.

Referring again to FIG. 3 are shown two spanner slots **39*b* where a spanner wrench (not shown) is able to engage and to either turn or prevent from turning the fifth coupling 39. Not shown are similar types of provisions including other slots, screws, and access holes that are provided on certain of the other component parts of the injector 10** to facilitate the assembly or disassembly thereof.

OPERATION

Hereinbefore in the specification during a description of certain of the principle elements of the invention the sequence of general grout repair procedures which require the drilling of the hole 13, assembly of all sections **18*a* , 18*b* , 18*c* , 18*d* of packer pipe 18 along with the cup packer 19, resident rod 20, and valve assembly 21, followed by the insertion of the injector 10 into the packer pipe 18** have been described.

It has also been stated hereinbefore that water pressure (or the pressure as created by some other fluid) acting upon the pump-in glands 25 and the rear surface of the injector 10 is used to convey the injector 10 to its proper position at the end of the packer pipe 18 and also to expel any fluids originating from the crack 11 that have entered into the packer pipe 18.

The outside diameter of the injector 10 body is chosen to be less than the inside diameter of the packer pipe 18. This is an intentional design attribute which, after the injector 10 is in its proper position within the packer pipe 18, permits water to flow in the area that is created between the outside of the injector 10 and the inside of the packer pipe 18, past the body of the injector 10 and to arrive at the valve assembly 21.

Consequently, to accommodate the tolerance that exists between the injector 10 and the packer pipe 18, the resin valve seat 55 of the injector 10 has a beveled nose **55*a* which, along with the corresponding beveled edge 54*a* of the valve bushing 54, ensures that the resin valve seat 55 aligns with and enters into the center portion of the valve assembly 21**.

The beveled nose **55*a* of the valve seat 55 further ensures that the valve seat 55 will pass through the O-ring 57 seal and come to rest with the beveled edge 53*a* of the seventh coupling 53 making contact with the beveled edge 54*a* of the valve bushing 54 when the injector 10 is pumped to its final position within the packer pipe 18. The valve seat 55 passing through the O-ring 57 provides a seal that prevents any fluids on the discharge side of the valve assembly 21 from passage to the injector 10 side of the valve assembly 21**.

After the injector 10 has reached its position at the end of the packer pipe, the flow of resin through the urethane injection hose 26 is started. It is the flow of resin through the center channel 30 of the injector 10 that is used to engage the locking dogs 22 and to secure the injector 10 in position within the packer pipe 18.

It is noted that the injector 10 system would function equally well with many types of chemical grouts if the resin were instead to be pumped through the water inlet port 27 (instead of into the urethane injection hose 26) and if the catalyst were accordingly to be pumped instead through the urethane injection hose 26. Operator discretion is used to determine the preferred conduit for pumping each of the grout components to the injector 10. For consistency of discussion it is assumed that, for the rest of this discussion, the resin is pumped into the urethane injection hose 26 and that the catalyst (water) is pumped into the water inlet port 27.

As the flow of resin fills up the center area 30 of the injector 10 hydraulic pressure increases. The pressure attempts both to open the resin valve 58 and also to push the resin piston 46 away from the seventh coupling 53.

The spring constant of the second coil spring 49 is selected so as to ensure that the force required to compress the second coil spring 49 by the sixth coupling 45 as it is being urged by the resin piston 46 as a consequence of the hydraulic pressure induced within the channel area 30 of the injector 10 by the flow of resin therein is less than the required hydraulic pressure that is necessary to cause the resin valve 48 to open by overcoming the force as exerted by the resin spring 47.

This ensures that as hydraulic resin pressure increases within the injector 10, the resin piston 46 is urged along the longitudinal axis of the injector 10 in a direction that is generally towards the collar area prior to any opening of the resin valve 48. The motion by the resin piston 46 causes the second pipe nipple 44 and in turn the dog pivot coupling 40 to move correspondingly in a direction that is generally towards the collar area of the packer pipe 18.

As the dog pivot coupling 40 moves toward the collar area, the locking dogs 22 are removed from a position of contact with the dog retractor lips 43 and are therefore able to pivot, as urged by the leaf springs 23, away from the body of the injector 10 into a position of contact with the locking area 18*g*. As hydraulic pressure continues to build, the locking dogs 22 bear upon the end threads 18*h* thereby securing the injector 10 in position within the packer pipe 18 for as long as the flow of resin continues.

As such, the flow of resin within the injector 10 provides a means first of automatically locking and securing the injector 10 in the proper position within the packer pipe 18. As the flow of resin continues, the hydraulic pressure continues to increase until the force exerted upon the back surface of the resin valve 48 is sufficient to overcome the restraining force as exerted by the resin spring 47 causing the resin valve 48 to open and allowing the passage of resin to occur therein.

The overall outside diameter of the injector 10, with the exception of the pump-in glands 25, as hereinbefore mentioned, is less than the inside diameter of the packer pipe 18. When the injector 10 is secured in the proper position within the packer pipe 18, the pump-in glands 25 occupy the enlarged area as provided by the water by-pass 24.

This allows for the catalyst (water in this discussion), which is being supplied simultaneously but separately along with the resin, to flow down the packer pipe 18 around the urethane injection hose 26, around the pump-in glands 25, around the body of the injector 10 along the inside surface of the three specially modified threaded sections 18*a*, 18*b*, 18*c* until the water makes contact with the valve assembly 21. The valve assembly 21 that is secured between the second section 18*b* and the first section 18*a* provides a substantially water-tight seal as it bears directly against the lip 18*e*.

As water is continually being pumped, the hydraulic water pressure as induced by the flow of water to the injector 10 increases, until eventually the hydraulic water pressure is able to overcome the force as exerted by each of the water valve springs 58*a* thereby opening the water valves 58 and permitting the flow of water to occur therein.

The simultaneous flow of water through the water valves 58 and the flow of resin through the resin valve 48 result in the mixing together of the resin and water (the catalyst) to occur for the first time on that side of the valve assembly 21 referred to, in general, as the discharge side. The two substances are reacted further by the more thorough mixing that is accomplished as the grout, which is now forming, passes through the resident rod 20 and ultimately is discharged from the end of the cup packer 19 and into the crack 11 where it cures (sets) and bonds to the surfaces therein.

As the resin and catalyst mix together in the resident rod 20, a chemical reaction occurs whereby a durable and expansive grout is produced. By controlling the placement of the resident rod 20 (and injector 10) with respect to the crack 11, a method is obtained whereby the grout is reacted in ideal proximity to the crack 11.

As such the reacted grout is forcibly being injected into the crack 11 while it continues to expand and also as it begins to set as a consequence of the continued flow of resin and catalyst that is being pumped to the injector 10. Providing an ideal location for reacting the resin with the catalyst ensures that when the resultant newly reacted grout is thereafter injected into the crack 11, it will provide an optimum bond with the crack 11 surroundings and that it will also properly form an expansive mass capable of adequately sealing the crack 11.

The flow of water and resin is maintained in this manner until that portion of the crack 11 to which access is provided by the hole 13 is filled with grout. At such point the pressure on the discharge side of the valve assembly 21 increases substantially, and the injector 10 system will simply refuse to accept any more water or resin.

This condition is evidenced by a rapid increase in pressure by the walking beam pumps for both the water and the resin. The increase in pressure that is evidenced when a portion of the crack 11 is filled with grout also results in the pressure setting of the regulators (not shown) of the walking beam pump (or pumps) to be exceeded thereby causing a suspension of the flow of water and resin into the injector 10 system.

To remove the injector 10 from the packer pipe 18, the flow of water and resin is stopped. The hydraulic pressure that was induced by the flow of resin within the injector 10 drops to near zero and, as a result, the second coil spring 49 urges the sixth coupling 45, second pipe nipple 44, resin piston 46, and the dog pivot coupling 40 to move in a direction that is generally towards the valve assembly 21.

As the dog pivot coupling 40 moves toward the valve assembly 21, the locking dogs 22 subsequently are forced bear against the dog retractor lips 43 and to pivot in towards the body of the injector 10 thereby releasing the injector 10 from a captive position within the packer pipe 18. The urethane injection hose 26 is used to hoist the injector 10 from the packer pipe 18 for subsequent use elsewhere in a second bored hole (not shown).

An additional fail-safe means is provided to ensure that the injector 10, after first having stopped the flow of resin thereto, can be removed easily from the packer pipe 18 simply by pulling on the urethane injection hose 26 at the collar area. As the urethane injection hose 26 is pulled, the first coupling 31 and second coupling 33 transfer the force of pulling equally to the fifth coupling 39, fourth coupling 38, and third coupling 34 which, in turn, then move longitudinally to compress the first coil spring 35 in proportion to the force applied.

As the fifth coupling 39, fourth coupling 38, and third coupling 34 all move in a direction that is generally towards the collar area, the leaf springs 23 that are attached to the fifth coupling 39 are also moved correspondingly away from their position of contact with the locking dogs 22. This ensures that after pulling the urethane injection hose 26, the leaf springs 23 are no longer in a position where they can either retard or prevent the retraction of the locking dogs 22 from otherwise occurring.

Therefore the second coil spring 49 is able to urge the dog pivot coupling 40 to move so as to cause the locking dogs 22 to pivot in towards the body of the injector 10 without encountering any resistance by the leaf springs 23.

If an excessive pulling force is applied to the urethane injection hose 26 the first coil spring 35 is then compressed fully between the third coupling 34 and the first fitting 36. In that instance the first fitting 36 prevents separation of the injector 10 from occurring as neither it nor the first coil spring 35 are able to pass beyond the third coupling 34.

After the injector 10 has been removed, the packer pipe 18 is loosened from the packer pipe clamp 28 and is removed as well, section by section, for use elsewhere. The injector 10 is used in as many bored holes (not shown) as is necessary to supply an adequate amount of grout to completely fill the expanse of the crack 11, or in the case of freezing the sands, to fill the expanse that is located underneath the reinforced structure.

It is noted that while the resin and the catalyst of certain binary grouts are being reacted together, that certain toxic vapors are sometimes produced. If the resin and the catalyst were to be reacted near the collar area in the gallery, the workmen (not shown) therein would be subjected to possible exposure to dangerous fumes. The injector 10 system, by reacting the grout components near the crack 11 and away from the workmen, lessens the hazards of exposure by the workmen to toxic vapors produced by the reaction of the grout components together.

The various component parts of the long hole chemical grout injector system have been described hereinbefore. The use of certain metals and alloys is preferred in the manufacture of certain of these components although other materials, metals, and alloys may be used instead of those preferred without departing from the spirit or the scope of the invention. For example, while other materials may be substituted for those preferred, the alloy that is used in the construction of the second coupling 33, fourth coupling 38, second fitting 50, and seventh coupling 53 is brass.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A chemical grout injection system for sealing a crack in a structure, access to said crack being provided by at least one hole formed in said structure, said system comprising:

pipe means in sections of predetermined lengths and including means for assembling at least two of said sections together to form a lining for said hole to a predetermined depth;

path defining means for forming at least two chemically separate paths within said pipe means;

valve means attached to each of said chemically separate paths at said predetermined depth;

means for inserting said path defining means into said lining;

means for securing said path defining means at a predetermined location in said lining; and means for removing said path defining means from said lining;

whereby grout is formed from at least two chemically reactive components as they combine at said predetermined depth for filling said crack.

2. The chemical grout injection system of claim 1 wherein said means for securing said path defining means at said predetermined location in said lining includes locking dog means and leaf spring means, whereby said locking dog means is actuated by an increase in the hydraulic pressure within said path defining means by one of said two chemically reactive components.

3. The chemical grout injection system of claim 1 wherein said means for removing said path defining means from said lining includes means for releasing said path defining means from said predetermined location in said lining.

4. The chemical grout injection system of claim 3 wherein said means for releasing said path defining means from said predetermined location within said lining includes means to apply a withdrawal force on one of said path defining means to produce a sliding action thereon to urge it longitudinally in a direction away from a locking condition.

5. The chemical grout injection system of claim 1 including means to mix said at least two chemically reactive components attached to said path defining means at said predetermined depth.

6. The chemical grout injection system of claim 5 wherein said means to mix said at least two chemically reactive components includes resident rod means.

7. The chemical grout injection system of claim 6 wherein said resident rod means includes static means fixedly attached and located within said resident rod means whereby said static means substantially interferes with and redirects the flow of said at least two chemically reactive components passing through said resident rod means.

8. The chemical grout injection system of claim 1 including means for recovery of said pipe means from said one or more holes formed in said structure.

9. The chemical grout injection system of claim 1 including means for sealing said pipe means at said predetermined depth to prevent a flow of fluids into said pipe means other than said at least two chemically reactive components.

10. The chemical grout injection system of claim 9 wherein said means for sealing said pipe means to prevent a flow of fluids other than said at least two chemically reactive components includes valve assembly means secured on one end of said pipe means forming a seal means between said valve means and said pipe means, and having a second seal means in said valve means between said valve means and said path defining means.

11. The chemical grout injection system of claim 1 including end sealing means for sealing a space between said pipe means and said one or more holes against fluid flow from said crack at said predetermined depth, and including means to attach said end sealing means to said pipe means at said predetermined depth.

12. The chemical grout injection system of claim 11 wherein said end sealing means for sealing a space between said pipe means and said one or more holes against fluid flow from said crack at said predetermined depth includes cup packer seal means.

13. The chemical grout injection system of claim 1 wherein said pipe means includes specially modified sections of pipe for cooperative engagement with said valve means and with said path defining means.

14. The chemical grout injection system of claim 1 wherein said path defining means includes conduit means located substantially coaxially within said pipe means for supplying one or more of said at least two chemically reactive components.

15. The chemical grout injection system of claim 14 including means to mix said at least two chemically reactive components together at said predetermined depth.

16. The chemical grout injection system of claim 15 wherein said path defining means includes means for securing said path defining means in a position of cooperative engagement with said pipe means and a release means for releasing said path defining means from said position of cooperative engagement.

17. The chemical grout injection system of claim 15 wherein said means to mix said at least two chemically reactive components together at said predetermined depth includes resident rod means.

18. The chemical grout injection system of claim 17 wherein said resident rod means includes stationary means within said resident rod means for substantially redirecting and mixing said at least two chemically reactive components.

19. The chemical grout injection system of claim 1 including expulsion means to expel fluids originating from any pervasive flow occurring through said crack and entering into said pipe means out from said pipe means and back into said crack.

20. The chemical grout injection system of claim 19 wherein said expulsion means includes pump-in gland seal means about the periphery of said path defining means, and means to urge said pump-in gland seal means and said path defining means into said pipe means thereby expelling said fluids.

21. The chemical grout injection system of claim 1 wherein said means for inserting said path defining means into said lining includes means for urging said path defining means into said pipe means.

22. The chemical grout injection system of claim 21 wherein said means for urging said path defining means into said pipe means includes pump-in gland seal means about the periphery of said path defining means, and means for urging said pump-in gland seal means and said path defining means into said pipe means.

23. The chemical grout injection system of claim 22 wherein said means for urging said pump-in gland seal means and said path defining means into said pipe means includes hydraulic pressure means whereby one of said at least two chemically reactive components is furnished to said path defining means under hydraulic pressure.

24. The chemical grout injection system of claim 1 including means for sealing said pipe means futhermost from said predetermined depth to prevent a flow of fluids into said pipe means other than said at least two chemically reactive components.

* * * * *